United States Patent [19]

Mink

[11] 4,041,596

[45] Aug. 16, 1977

[54] FASTENING DEVICE

[76] Inventor: George Mink, 13130 Geoffrey, Warren, Mich. 48093

[21] Appl. No.: 634,661

[22] Filed: Nov. 24, 1975

[51] Int. Cl.[2] ..... B23P 11/00; B21J 15/12

[52] U.S. Cl. ..... 29/243.53; 72/125

[58] Field of Search ..... 29/243.5, 243.53; 72/406, 125, 126

[56] References Cited

U.S. PATENT DOCUMENTS

| | | | |
|---|---|---|---|
| 3,646,660 | 3/1972 | Sheffer | 29/243.53 |
| 3,768,137 | 10/1973 | Russell | 29/243.53 X |
| 3,899,909 | 8/1975 | Taruntaev | 29/243.53 X |

*Primary Examiner*—Al Lawrence Smith
*Assistant Examiner*—J. C. Peters
*Attorney, Agent, or Firm*—Harness, Dickey & Pierce

[57] ABSTRACT

A fastening device for affixing trim pieces to a backing piece. The fastening device comprises head forming tools for upsetting projections of the trim piece to secure them to the backing piece. In addition, a compression member is associated with the forming tool and is adapted to put a desired degree of precompression on the backing piece during the upsetting operation.

8 Claims, 4 Drawing Figures

FASTENING DEVICE

BACKGROUND OF THE INVENTION

This invention relates to a fastening device and more particularly to an improved fastening device for affixing trim pieces to resilient backing pieces.

In my U.S. Pat. No. 3,618,352, entitled "Cutoff Tool and Method", issued Nov. 9, 1971, there is illustrated a machine for affixing trim pieces to a backing piece. The machine described in that patent is particularly useful in combinations where the backing piece is relatively rigid. It has been found, however, that other types of apparatus may be more desirable for affixing the trim piece to the backing piece where the backing piece is more resilient in nature. With such an arrangement, it is desirable to provide a precompression loading on the backing piece so as to prevent damage during the fastening operation.

It is, therefore, a principal object of the invention to provide an improved fastening device for affixing trim pieces to backing pieces.

It is another object of the invention to provide an improved tool for affixing trim pieces to resilient backing pieces.

SUMMARY OF THE INVENTION

This invention is particularly adapted to be embodied in a fastening apparatus for affixing a trim piece having a projection to a backing piece having an opening therethrough. The fastening apparatus comprises a forming tool that is adapted to cooperate with the projection to upset its end when extending through the opening in the backing piece for affixing the trim piece to the backing piece. A compression member is adapted to engage the backing piece and apply a compressive load thereto contiguous to its opening. Means are provided for supporting the compression member for limited movement relative to the forming tool upon engagement of the compression member with the backing piece to facilitate movement of the forming tool into engagement with the projection. Biasing means act on the compression member for applying a resilient force through the compression member to the backing piece upon the relative movement.

DETAILED DESCRIPTION OF THE PREFERRED EMBODIMENT

Figure 4:
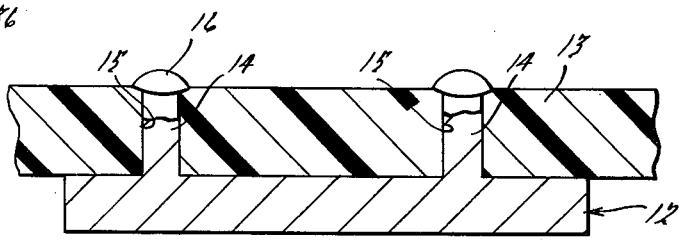
FIG. 4 is a cross sectional view, on the same scale as FIG. 1, showing the finished connection made by the tool.

A tool embodying this invention is identified generally by the reference numeral 11. The tool 11 is particularly adapted for securing trim pieces, indicated generally by the reference numeral 12 to backing pieces 13. The backing piece 13 is normally formed from a relatively soft plastic material such as vinyl. Each trim piece to be fastened has two or more extending projections 14 that extend through openings 15 in the backing piece. The tool 11 is adapted to form upsets or heads 16 (FIG. 4) at the ends of the projections 14 so as to lock the trim piece 12 to the backing piece 13. In the illustrated embodiment, two projections 14 are employed. It is to be understood that the invention may be used in conjunction with any other number of projections, as will become apparent.

The tool 11 is comprised of a main housing assembly 17 that also forms a gear drive unit. The housing assembly 17 consists of an upper plate 18 that is adapted to be fixed in any suitable manner to an associated driving machine tool. The machine tool (not shown) includes a ram and rotating output shaft that is coupled to a connection of an input spindle 19 that is journaled by the housing 17 and which is accessible through an opening 21 formed in the upper plate 18.

The housing 17 includes a gear section 22 which is defined within an internal cavity. The gear section includes an input gear 23 that is affixed to the spindle 19, by means of a socket head screw 24. The input gear 23 drives a pair of output gears 25 and 26. The output gears 25 and 26 are keyed to respective output shafts 27 and 28. Each output shaft 27 and 28 is journaled in the housing 22 by means of upper and lower bearing assemblies 29 and 31. The bearing assemblies 29 and 31 are each pressed into respective bores 32 and 33.

Figure 3:
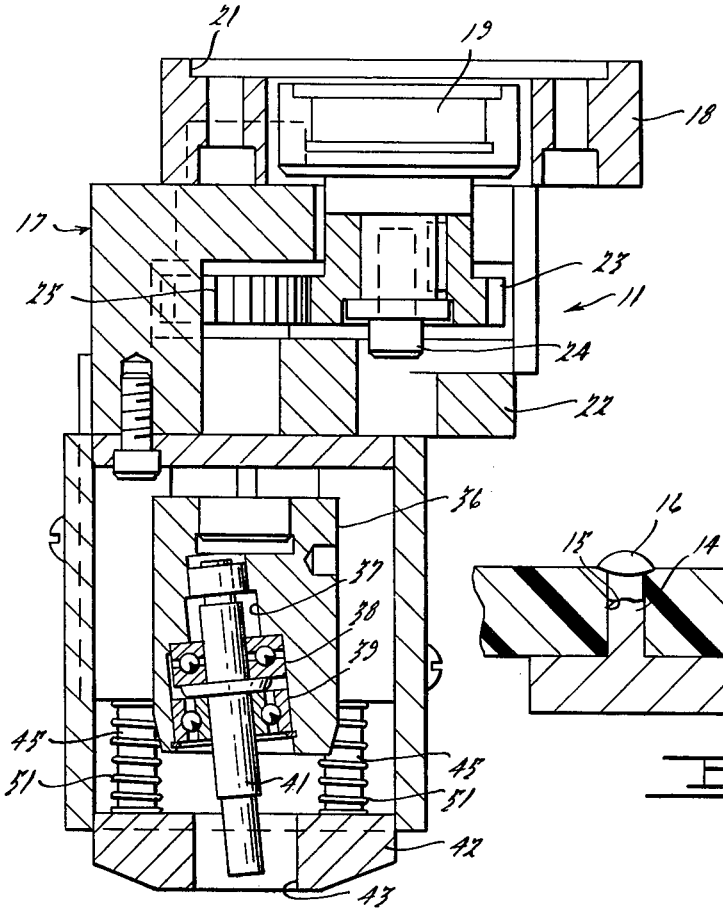
FIG. 3 is a cross sectional view, taken generally along the line 3—3 of FIG. 2.

Each output shaft 27 and 28 drives a respective head forming tool 34 and 35. The head forming tools 34 and 35 are identical in construction and are of the type as described in my U.S. Pat. No. 3,779,049, entitled "Head Forming Tool" and issued Dec. 18, 1973. Reference may be had to that patent for details of the construction of the tools 34 and 35. Briefly stated, however, each tool is comprised of an outer body portion 36 (FIG. 3) that is directly coupled to the respective input shaft 27 or 28. The housing 36 is formed with an angularly disposed opening 37 that supports a pair of antifriction bearings, 38 and 39, which in turn, journal a work forming member 41. The work forming member 41 is angularly disposed relative to the axis of rotation of the housing 36 and follows a planetary path across the head of the projections 14 upon rotation of the housing 36, as described in my aforementioned patent.

A compression plate 42 is carried at the lower end of the tool 11. The compression plate 42 has a number of openings 43 that coincide with the number of tools 34 and 35 employed. The holes 43 are sized to pass the forming tools 41 and accommodate their planetating movement. The plate 42 is formed with a number of tapped openings 44 that receive the threaded portions of socket headed screws 45. The socket headed screws 45, in turn, are slidably supported in bores 46 formed in a depending skirt shaped guide block 47 that is affixed to the gear housing 17 by means of socket headed screws 48. Counterbores 49 formed at the upper ends of the bores 46 accommodate the heads of the screws 45.

Coil compression springs 51 encircle the screws 45 and are interposed between the upper side of the plate 42 and a shoulder 52 formed at the lower end of the guide block 47. A skirt 53 is also affixed to the guide block 47 and slidably engages the outer periphery of the plate 42.

Figure 1:
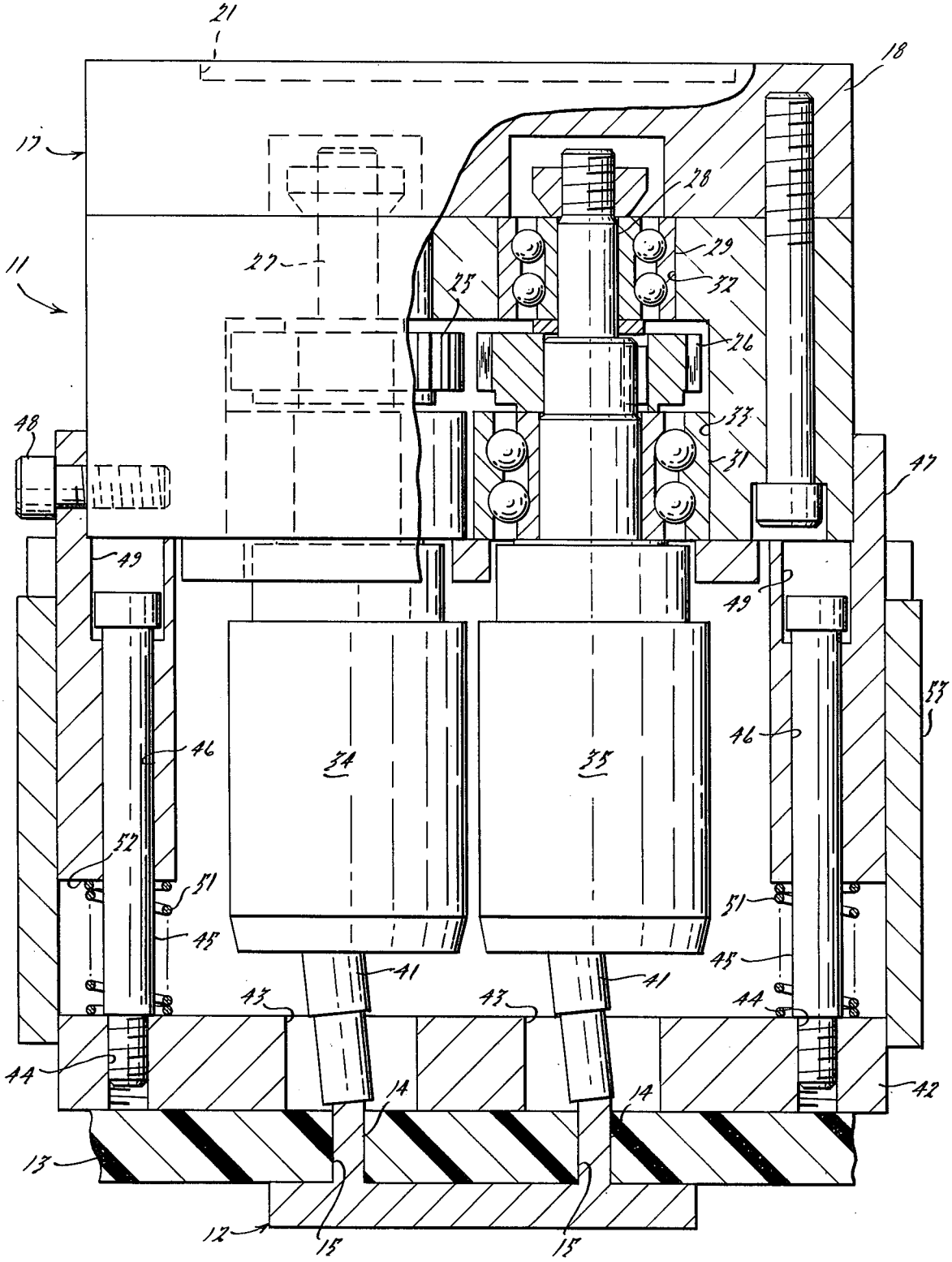
FIG. 1 is a side elevational view of a tool embodying this invention, with portions broken away and other portions shown in section.
Figure 2:
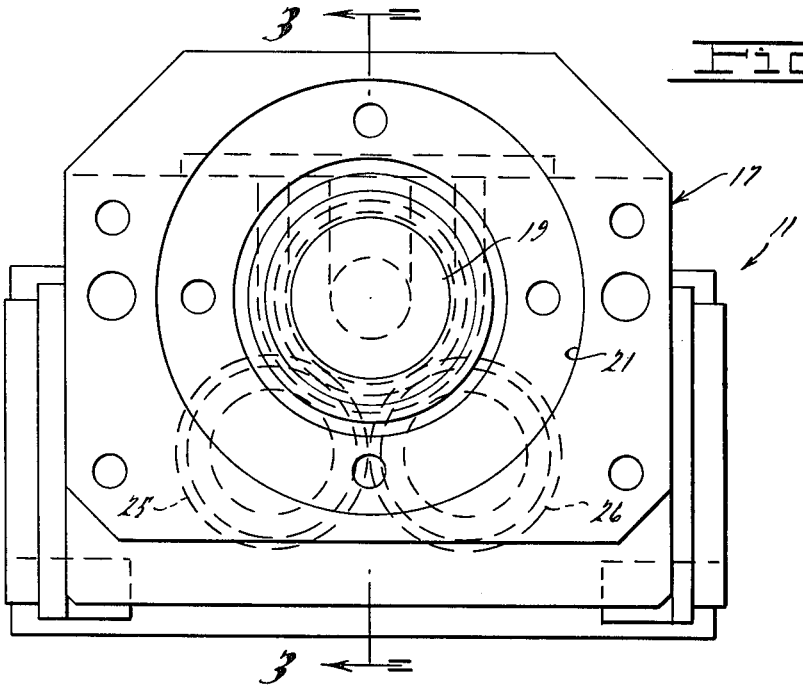
FIG. 2 is a reduced scale, top plan view of the tool shown in FIG. 1.

FIG. 1 illustrates the mechanism immediately prior to the beginning of the fastening operation. In this condition, the projections 14 will extend through the backing pieces 13 a sufficient distance so as to permit their upset. The entire tool 11 is moved downwardly by the cooperating machine tool until the plate 42 engages the upper surface of the backing piece 13. As the tool 11 is continuing to move downwardly, the springs 51 will compress and the plate 42 will put a compressive load on the backing piece 13. The input spindle 19 and tools 34 and 35 will be rotating at this time. As the downward movement continues, the forming tools 41 will engage the projections 14 and form the upsets 16 so as to secure the trim piece 12 to the backing piece 13. The tool 11 then may be retracted and the finished piece removed.

In the illustrated embodiment, as aforenoted, two projections 14 and two forming tools 34 and 35 were provided. It should be readily apparent that additional projections may be used for larger trim pieces with the addition of a like number of tools. Various other changes and modifications may be made without departing from the spirit and scope of the invention as defined by the appended claims.

I claim:

1. A fastening apparatus for affixing a trim piece having a projection to a backing piece having an opening therethrough, said fastening apparatus comprising a forming tool adapted to cooperate with the projection to upset the portion of its end extending through the backing piece opening against one side of the backing piece around said opening for affixing the trim piece to the backing piece, a compression member adapted to engage the one side of the backing piece and apply a compressive load thereto contiguous to the backing piece opening, means for supporting said forming tool and compression member for simultaneous movement from a retracted position until said compression member engages the one side of the backing piece and subsequently for limited movement of said forming tool relative to said compression member while said compression member is maintained in engagement with the one side of the backing piece for movement of said forming tool into engagement with the projection, said forming tool being adapted to upset the portion of the projection during the movement of said forming tool relative to said compression member, and biasing spring means acting on said compression member for applying a predetermined compression load upon the backing piece through said compression member upon the relative movement and during the upsetting of the projection portion.

2. A fastening apparatus as set forth in claim 1 wherein the compression member has an opening formed therein adapted to pass the forming tool.

3. A fastening apparatus as set forth in claim 1 wherein the fastening apparatus includes means for supporting the forming tool and the compression member for movement toward and away from the trim piece and backing piece.

4. A fastening apparatus as set forth in claim 3 wherein the supporting means includes a housing supporting an input shaft adapted to be coupled to an associated machine tool and an output shaft driven thereby and adapted to drive the forming tool.

5. A fastening apparatus as set forth in claim 4 wherein the trim piece has a pair of projections adapted to extend through a pair of openings in the backing piece, there being two forming tools supported by said housing, each of which is adapted to form an upset on a respective one of the projections, there being an output shaft driven by the input shaft for each such forming tool.

6. A fastening apparatus as set forth in claim 4 wherein the compression member has an opening formed therein adapted to pass the forming tool.

7. A fastening apparatus as set forth in claim 4 wherein the housing has a plurality of extending members operably connected to the compression member for supporting said compression member for limiting movement relative to the housing, the biasing spring means being interposed between said compression member and said housing.

8. A fastening apparatus as set forth in claim 7 further including a skirt depending from the housing and slidably encompassing the compression member.

* * * * *